US010934770B2

(12) United States Patent
Badenhorst

(10) Patent No.: US 10,934,770 B2
(45) Date of Patent: Mar. 2, 2021

(54) SLAT FOR A BLIND AND BLIND FORMED THEREFROM

(71) Applicant: Navus Consulting CC, Stellenbosch (ZA)

(72) Inventor: Marlene Badenhorst, Stellenbosch (ZA)

(73) Assignee: Navus Consulting CC, Stellenbosch (ZA)

( * ) Notice: Subject to any disclaimer, the term of this patent is extended or adjusted under 35 U.S.C. 154(b) by 159 days.

(21) Appl. No.: 16/094,425

(22) PCT Filed: Mar. 29, 2017

(86) PCT No.: PCT/ZA2017/050016
§ 371 (c)(1),
(2) Date: Oct. 17, 2018

(87) PCT Pub. No.: WO2018/018053
PCT Pub. Date: Jan. 25, 2018

(65) Prior Publication Data

US 2019/0128055 A1 May 2, 2019

(30) Foreign Application Priority Data

Jul. 20, 2016 (ZA) ..... 2016/05075

(51) Int. Cl.
*E06B 9/36* (2006.01)
*E06B 9/06* (2006.01)
(Continued)

(52) U.S. Cl.
CPC ..... *E06B 9/0638* (2013.01); *E04F 10/10* (2013.01); *E06B 9/0676* (2013.01); *E06B 9/302* (2013.01);
(Continued)

(58) Field of Classification Search
CPC .... E06B 9/0638; E06B 9/0676; E06B 9/0661; E06B 9/06; E06B 9/302; E06B 9/322;
(Continued)

(56) References Cited

U.S. PATENT DOCUMENTS 2,254,583 A 9/1941 Stuart
2,564,641 A 8/1951 Drake
(Continued)

FOREIGN PATENT DOCUMENTS

EP 1336714 A2 8/2003
EP 2336479 A1 6/2011
(Continued)

OTHER PUBLICATIONS

Written Opinion and International Search Report issued in International Application Serial No. PCT/ZA2017/050016, dated Jun. 7, 2017.

*Primary Examiner* — Johnnie A. Shablack
(74) *Attorney, Agent, or Firm* — Haugen Law Firm PLLP

(57) ABSTRACT

A blind made up of a plurality of customisable rigid slats enables the blind to be fitted snugly within any window opening or doorway as a result of the locking adjustability of the width of such slats. The slats each include a pair of elongate slat panels movable relative to one another between retracted and extended conditions, such that the operative width of the blind is greater in the extended condition than in the retracted condition. The blind further includes one or more fasteners, located at or near each of a pair of minor ends of the slat panels, for releasably fixing the pair of slat panels to one another in the retracted condition, the extended condition and/or any condition there between, thereby to operatively restrict relative movement between the slat panels in such condition.

15 Claims, 8 Drawing Sheets

(51) Int. Cl.

| | |
|---|---|
| ***E06B 9/386*** | (2006.01) |
| ***E04F 10/10*** | (2006.01) |
| ***E06B 9/322*** | (2006.01) |
| ***E06B 9/302*** | (2006.01) |
| *E06B 9/24* | (2006.01) |

(52) U.S. Cl.
CPC ..... *E06B 9/322* (2013.01); *E06B 9/36* (2013.01); *E06B 9/364* (2013.01); *E06B 9/368* (2013.01); *E06B 9/386* (2013.01); *E06B 2009/2476* (2013.01)

(58) Field of Classification Search
CPC . E06B 9/364; E06B 9/368; E06B 9/36; E06B 9/362; E06B 9/365; E06B 9/367; E06B 9/386; E06B 9/384; E06B 9/388; E06B 2009/2476
See application file for complete search history.

(56) References Cited

U.S. PATENT DOCUMENTS

| | | | | |
|---|---|---|---|---|
| 2,654,425 | A | 10/1953 | Hayner | |
| 2,875,827 | A | 3/1959 | Zack | |
| 3,061,005 | A | 10/1962 | Otto et al. | |
| 3,280,891 | A | 10/1966 | Eldredge et al. | |
| 3,520,346 | A | 7/1970 | Green | |
| 3,853,169 | A | 12/1974 | Music | |
| 4,715,421 | A | 12/1987 | Erber | |
| 5,291,946 | A | 3/1994 | Ciriaci | |
| 5,303,760 | A | 4/1994 | Perez | |
| 5,566,738 | A | 10/1996 | Yadidya | |
| 5,626,177 | A * | 5/1997 | Colson | E06B 9/262 160/168.1 V |
| 5,687,785 | A * | 11/1997 | Erber | E06B 9/34 160/232 |
| 5,819,833 | A * | 10/1998 | Swiszcz | E06B 9/262 160/168.1 V |
| 5,954,110 | A * | 9/1999 | Ingram | E06B 9/36 16/94 R |
| 6,491,085 | B1 * | 12/2002 | Anthony | E06B 9/262 160/168.1 V |
| 9,145,732 | B2 | 9/2015 | Frigerio | |
| 9,175,511 | B2 | 11/2015 | Whytlaw | |
| 9,598,898 | B2 * | 3/2017 | Colson | E06B 9/36 |
| 10,053,910 | B2 * | 8/2018 | Avinger | E06B 9/386 |
| D853,149 | S * | 7/2019 | Badenhorst | E06B 9/262 D6/580 |
| 10,458,179 | B2 * | 10/2019 | Hall | E06B 9/322 |
| 2003/0034134 | A1 | 2/2003 | Saralou et al. | |
| 2003/0213567 | A1 | 11/2003 | Markley | |
| 2005/0230061 | A1 | 10/2005 | Wilkins | |
| 2007/0163726 | A1 * | 7/2007 | Lewis | E06B 9/386 160/168.1 R |
| 2007/0163732 | A1 * | 7/2007 | Konstantin | A47H 23/06 160/237 |
| 2008/0017333 | A1 * | 1/2008 | Chen | A47H 15/02 160/330 |
| 2008/0163986 | A1 * | 7/2008 | Li | A47H 23/04 160/175 |
| 2008/0216965 | A1 * | 9/2008 | Ellbogen | A47H 23/04 160/126 |
| 2008/0236766 | A1 * | 10/2008 | Vandervoort | B29C 66/7485 160/172 V |
| 2010/0000691 | A1 | 1/2010 | Levy et al. | |
| 2011/0056630 | A1 * | 3/2011 | Buccola, Jr. | E06B 9/36 160/168.1 V |
| 2012/0124872 | A1 | 5/2012 | Lim | |
| 2016/0237741 | A1 * | 8/2016 | Greene | E06B 9/262 |
| 2017/0354285 | A1 * | 12/2017 | Kim | E06B 9/36 |
| 2018/0363366 | A1 * | 12/2018 | Ammerlaan | E04F 10/02 |
| 2019/0128055 | A1 * | 5/2019 | Badenhorst | E06B 9/0676 |

FOREIGN PATENT DOCUMENTS

| | | | |
|---|---|---|---|
| EP | 2455561 | A2 | 5/2012 |
| WO | 2007091268 | A2 | 8/2007 |

* cited by examiner

SLAT FOR A BLIND AND BLIND FORMED THEREFROM

BACKGROUND OF THE INVENTION

THIS invention relates to a slat for a blind and a blind formed from such slats. More specifically, the invention relates to a customisable rigid slat, or blind made up of a plurality of such customisable rigid slats, that enables the blind to be fitted snugly within any window opening or doorway as a result of the locking adjustability of the width of such slats.

Blinds, and specifically blinds made up from rigid slats are well known. For example, U.S. Pat. No. 3,853,169 discloses a shutter blind comprising a number of rigid shutters operative across a support structure, which shutters (in one embodiment) each comprise a pair of panels being freely movable relative to one another thereby to enable overlapping sides of adjacent shutters to mate in a stepped formation for the purposes of, in a shut condition, minimising the amount of light capable of passing therethrough.

A disadvantage of the invention as disclosed in U.S. Pat. No. 3,853,169 is that the shutter blind must be custom built to fit the window opening thereby to ensure that in the most spaced condition of the shutters across the support structure, the shutters are still capable of overlapping.

It is an object of the present invention to provide a slat and a blind made up of such slats that not only addresses the shortcomings of the known prior art, but also doubles as a security barrier and enables frequent decorative customisation.

SUMMARY OF THE INVENTION

According to the invention there is provided a slat for a blind including:

a pair of elongate slat panels having: (i) opposing primary and secondary surfaces; (ii) opposing primary and secondary major sides; and (iii) opposing primary and secondary minor ends; the slat panels being slidably movable relative to one another between a retracted condition, wherein the respective primary and secondary major sides of each of the slat panels lie in close proximity and/or in alignment with one another, and an extended condition, wherein the respective primary and secondary major sides of each of the slat panels are spaced relative to one another such that a dimension of the slat, as measured between the primary major side of one of the slat panels and the secondary major side of the other of the slat panels, is variable; and one or more fasteners, located at or near each of the opposing primary and secondary minor ends of the slat panels, for releasably fixing the pair of slat panels to one another in the retracted condition, the extended condition and/or any condition there between, thereby to operatively restrict relative movement between the slat panels in such fixed condition.

In one embodiment, each of the slat panels may be overlaid on the secondary surface thereof with an elongate cover panel to form a composite slat panel, and further wherein the opposing primary and secondary minor ends of the slat panels longitudinally extend beyond respective opposing primary and secondary minor ends of the cover panels thereby to expose end portions on the slat panels for receiving the fasteners for releasably fixing the slat panels to one another.

Generally, each of the exposed end portions of the slat panels define therein at least two fastening apertures spaced apart from one another across a dimension spanning between the opposing primary and secondary major sides of the respective slat panel, such that the fasteners are receivable through aligned fastening apertures in corresponding exposed end portions of the slat panels thereby to releasably fix the composite slat panels to one another.

Typically, the fasteners are bolts and nuts with a shank portion of the respective bolt passing through the aligned fastening apertures such that the composite slat panels are operably clamped together between the head of the bolt, and the nut threadably tighten onto the shank thereof.

Preferably, at least one of the fastening apertures is a fastening slot and further wherein, and with the respective bolt and nut operably loosened, the shank of the bolt is capable of riding along the fastening slot thereby to enable slidable movement between the composite slat panels, the composite slat panels being operably fixable to one another by retightening the bolt and nut thereby to force the primary surfaces of the composite slat panels into contact with each other, or an intermediate member therebetween, such that frictional forces acting between the respective contact surfaces frictionally lock the composite slat panels in position relative to one another.

In an alternative embodiment, each of the slat panels is substantially overlaid on the secondary surface thereof with an elongate cover panel thereby to form a composite slat panel with opposing primary and secondary minor ends of the cover panel being substantially aligned with the respective primary and secondary minor ends of the respective slat panel, and further wherein the fasteners are clamps located at or near each of the opposing primary and secondary minor ends of the composite slat panels for releasably clamping:

(i) the cover panel to the respective slat panel; and (ii) the pair of composite slat panels to one another such that the primary surfaces of each of the composite slat panels is operably forced into contact with each other, or an intermediate member therebetween, such that frictional forces acting between the respective contact surfaces frictionally lock the composite slat panels in position relative to one another.

Generally, the clamps at each of the opposing primary and secondary minor ends of the composite slat panels are each made up of a first clamping member and a second clamping member between which the respective minor ends of such composite slat panels are capable of being releasably clamped.

Typically, each of the first and the second clamping members define therein at least first and second fastening apertures spaced apart from one another across a dimension spanning between the opposing primary and secondary major sides of the composite slat panels to which the clamping members are fastenable, such that bolts are receivable through aligned fastening apertures in each of the first and second clamping members thereby to releasably clamp the composite slat panels to one another.

Preferably, at least a first bolt passes through the first fastening aperture in the first clamping member to threadably engage the second fastening aperture in the second clamping member, and further wherein at least a second bolt passes through the first fastening aperture in the second clamping member to threadably engage the second fastening aperture in the first clamping member such that the clamping members, and consequentially the composite slat panels sandwiched therebetween, are operably clamped together by threadably tightening the first and second bolts into the respective second fastening apertures.

More preferably, the first fastening aperture in each of the clamping members is a fastening slot and further wherein, and with the respective bolt passing through such fastening slot loosened from the corresponding second fastening aperture, the shank of the bolt is capable of riding along the fastening slot thereby to enable slidable movement between the clamping members and consequentially the composite slat panels, the composite slat panels being operably clamped to one another by retightening the bolt into the second fasting aperture to force the primary surfaces of the composite slat panels into contact with each other, or the intermediate member therebetween, to frictionally lock the composite slat panels in position relative to one another.

Furthermore, the slats include first and second mounting posts extending axially outwardly from each of the respective opposing primary and secondary minor ends of the one or both composite slat panels, and on which the slat is rotatably mountable within a support structure of the blind.

Generally, the respective mounting post extends from a mount fastened to one or both of the composite slat panels by the fasteners.

Typically, the mounting post is restricted against rotation relative to the mount, and consequentially restricted against rotation relative to the composite slat panels to which the mount is fastened.

Preferably, the slats include a gear cluster co-operative between: (i) each of the first and the second clamping members; and (ii) the mount; for translating a rotational motion imparted on one of the gears into a linear sliding motion of the first and the second clamping members, and consequently the composite slat members, relative to one another.

The gear cluster may be made up from: (i) a pair of pinion gears supported on the mount and meshed indirectly to one another via an intermediary gear; and (ii) a rack gear formation on each of the first and the second clamping members.

The rack gear formations are generally located adjacent locating slots, defined in each of the first and the second clamping members and along which a portion of: (i) a protuberance of the pinion gears; or (ii) a fastener for fastening the pinion gears to the mount; is slidably captive.

At least one of the major sides of the slat panels may comprises an engagement lip therealong for engaging the corresponding major side of the respective cover panel. Preferably, the engagement lip is substantially U-shaped.

Generally, the cover panel is permanently attached or releasably attachable to the respective slat panel, the cover panel further being:

(i) one or more photovoltaic panels for generating electricity;

(ii) a decorative panel; and/or (iii) a transparent or translucent panel through which a intermediate decorative panel is viewable, the intermediate decorative panel being securable in position sandwiched between the slat panel and the cover panel.

The decorative panel and/or the intermediate decorative panel may also be interchangeable and/or customisable.

Typically, ends of the first and second mounting posts, opposite to the ends thereof mounted to the slat, are engageable with respective first and second carriages, which carriages operably ride along respective first and second tracks of the support structure of the blind such that the slat, or a plurality of such slats, are slidably supported by the carriages along the lengths of the tracks.

Preferably, the first and/or the second carriages of each of the slats house a gearing cluster therein, and further wherein the geared carriages are interconnected thereby to transmit a rotational motion imparted on one of the slats to synchronised rotational motion of the other slats, such that in use, the slats are rotatable about their respective central slat axes, passing through their respective first and second mounting posts, between an open condition, wherein the major sides of adjacent slats are spaced relative to one another, and a shut condition, wherein the major sides of adjacent slats overlap one another.

The geared carriages may be interconnected via a connector rod such that rotational motion of the slats about their respective central slat axes is translatable into a rotational motion of the connector rod about its central rod axis, which central rod axis is perpendicular to the central slat axes, such that operable rotation of any one slat or the connector rod causes synchronise rotation of all of the interconnected slats.

Furthermore, the plurality of slats are further interconnected, directly or indirectly, by one or more collapsible frames such that adjacent slats are slidably movable relative to one another across the tracks, the collapsible frames being configurable between an expanded condition and a compact condition.

In the expanded condition, the slats are generally spaced apart from one another along the track by the collapsible frame in an erected form. In the compact condition, the slats are typically bunched together in close proximity to one another. Preferably, the collapsible frames are configured to retain the spacing between the plurality of adjacent slats equidistant whether in the expanded condition, the compact condition or any condition therebetween.

The slats are slidably movable into the compact condition near any one end of the track, or any other position therebetween. Furthermore, the collapsible frame may be a system of hinged and jointed trusses taking a pantograph-type form.

Generally, the carriages ride along their respective tracks on bearings, wheels or bushings, the tracks being in the form of elongate track members having a substantially C-shaped cross-section, the carriages being slidably captive within the elongate track members with the mounting posts connected between the carriages and the slats running along slots defined in such elongate track members.

Typically, one or more driving means and/or transmissions drive: (i) the relative movement of the slats between the retracted and extended condition; (ii) the rotation of the slats between the open and shut conditions; and (iii) the sliding of the slats along the tracks between the expanded and compact condition; the driving means being manual and/or mechanised.

Preferably, the one or more transmissions is a system of pulleys and cords for at least driving the sliding of the slats along the tracks between the expanded and compact condition, the driving means and transmissions being substantially hidden from view within the support structure of the blind, such that manual or mechanised actuation of any one slat will drive the rotation and the sliding of the remaining slats.

More preferably, the one or more panels making up the slats are rigid thereby to in use act as a security barrier across a window opening or doorway across which the support structure of the blind is operably fitted.

Most preferably, the slats are releasably lockable against rotation by one or more first locks acting on the slats, the carriages or the connector rod, and further wherein the slats are releasably lockable against sliding movement along the track by one or more second locks acting on the collapsible frames or the carriages.

In one particularly preferred embodiment of the invention, one or more detectors are configured to monitor unauthorised movement of the slats, and/or unauthorised movement of an object between the slats, thereby to trigger an alarm and/or notification operably as a result of such unauthorised movement.

According to a second aspect of the invention, there is provided a blind including:

a support structure; and a plurality of slats supported on such support structure, each of the slats having:

a pair of elongate slat panels having: (i) opposing primary and secondary surfaces; (ii) opposing primary and secondary major sides; and (iii) opposing primary and secondary minor ends; the slat panels being slidably movable relative to one another between a retracted condition, wherein the respective primary and secondary major sides of each of the slat panels lie in close proximity and/or in alignment with one another, and an extended condition, wherein the respective primary and secondary major sides of each of the slat panels are spaced relative to one another such that a dimension of the slat, as measured between the primary major side of one of the slat panels and the secondary major side of the other of the slat panels, is variable; and one or more fasteners, located at or near each of the opposing primary and secondary minor ends of the slat panels, for releasably fixing the pair of slat panels to one another in the retracted condition, the extended condition and/or any condition there between, thereby to operatively restrict relative movement between the slat panels is such fixed condition.

In one embodiment, each of the slat panels may be overlaid on the secondary surface thereof with an elongate cover panel to form a composite slat panel, and further wherein the opposing primary and secondary minor ends of the slat panels longitudinally extend beyond respective opposing primary and secondary minor ends of the cover panels thereby to expose end portions on the slat panels for receiving the fasteners for releasably fixing the slat panels to one another.

Generally, each of the exposed end portions of the slat panels define therein at least two fastening apertures spaced apart from one another across a dimension spanning between the opposing primary and secondary major sides of the respective slat panel, such that the fasteners are receivable through aligned fastening apertures in corresponding exposed end portions of the slat panels thereby to releasably fix the composite slat panels to one another.

Typically, the fasteners are bolts and nuts with a shank portion of the respective bolt passing through the aligned fastening apertures such that the composite slat panels are operably clamped together between the head of the bolt, and the nut threadably tighten onto the shank thereof.

Preferably, at least one of the fastening apertures is a fastening slot and further wherein, and with the respective bolt and nut operably loosened, the shank of the bolt is capable of riding along the fastening slot thereby to enable slidable movement between the composite slat panels, the composite slat panels being operably fixable to one another by retightening the bolt and nut thereby to force the primary surfaces of the composite slat panels into contact with each other, or an intermediate member therebetween, such that frictional forces acting between the respective contact surfaces frictionally lock the composite slat panels in position relative to one another.

In an alternative embodiment, each of the slat panels may be substantially overlaid on the secondary surface thereof with an elongate cover panel thereby to form a composite slat panel with opposing primary and secondary minor ends of the cover panel being substantially aligned with the respective primary and secondary minor ends of the respective slat panel, and further wherein the fasteners are clamps located at or near each of the opposing primary and secondary minor ends of the composite slat panels for releasably clamping:

(i) the cover panel to the respective slat panel; and (ii) the pair of composite slat panels to one another such that the primary surfaces of each of the composite slat panels is operably forced into contact with each other, or an intermediate member therebetween, such that frictional forces acting between the respective contact surfaces frictionally lock the composite slat panels in position relative to one another.

Generally, the clamps at each of the opposing primary and secondary minor ends of the composite slat panels are each made up of a first clamping member and a second clamping member between which the respective minor ends of such composite slat panels are capable of being releasably clamped.

Typically, each of the first and the second clamping members define therein at least first and second fastening apertures spaced apart from one another across a dimension spanning between the opposing primary and secondary major sides of the composite slat panels to which the clamping members are fastenable, such that bolts are receivable through aligned fastening apertures in each of the first and second clamping members thereby to releasably clamp the composite slat panels to one another.

Preferably, at least a first bolt passes through the first fastening aperture in the first clamping member to threadably engage the second fastening aperture in the second clamping member, and further wherein at least a second bolt passes through the first fastening aperture in the second clamping member to threadably engage the second fastening aperture in the first clamping member such that the clamping members, and consequentially the composite slat panels sandwiched therebetween, are operably clamped together by threadably tightening the first and second bolts into the respective second fastening apertures.

More preferably, the first fastening aperture in each of the clamping members is a fastening slot and further wherein, and with the respective bolt passing through such fastening slot loosened from the corresponding second fastening aperture, the shank of the bolt is capable of riding along the fastening slot thereby to enable slidable movement between the clamping members and consequentially the composite slat panels, the composite slat panels being operably clamped to one another by retightening the bolt into the second fasting aperture to force the primary surfaces of the composite slat panels into contact with each other, or the intermediate member therebetween, to frictionally lock the composite slat panels in position relative to one another.

Furthermore, the blind includes first and second mounting posts extending axially outwardly from each of the respective opposing primary and secondary minor ends of the one or both composite slat panels, and on which the slat is rotatably mountable within the support structure of the blind. Preferably, the respective mounting post extends from a mount fastened to one or both of the composite slat panels by the fasteners.

Generally, the mounting post is restricted against rotation relative to the mount, and consequentially restricted against rotation relative to the composite slat panels to which the mount is fastened.

Typically, the blind includes a gear cluster co-operative between: (i) each of the first and the second clamping members; and (ii) the mount; for translating a rotational motion imparted on one of the gears into a linear sliding motion of the first and the second clamping members, and consequently the composite slat members, relative to one another.

Preferably, the gear cluster is made up from: (i) a pair of pinion gears supported on the mount and meshed indirectly to one another via an intermediary gear; and (ii) a rack gear formation on each of the first and the second clamping members. More preferably, the rack gear formations are located on adjacent locating slots, defined in each of the first and the second clamping members and along which a portion of: (i) a protuberance of the pinion gears; or (ii) a fastener for fastening the pinion gears to the mount; is slidably captive.

Generally, the at least one of the major sides of the slat panels comprises an engagement lip therealong for engaging the corresponding major side of the respective cover panel. Preferably, the engagement lip is substantially U-shaped.

Typically, the cover panel is permanently attached or releasably attachable to the respective slat panel, the cover panel further being:

(i) one or more photovoltaic panels for generating electricity;

(ii) a decorative panel; and/or (iii) a transparent or translucent panel through which a intermediate decorative panel is viewable, the intermediate decorative panel being securable in position sandwiched between the slat panel and the cover panel.

The decorative panel and/or the intermediate decorative panel may be interchangeable and/or customisable.

Preferably, ends of the first and second mounting posts, opposite to the ends thereof mounted to the slat, are engageable with respective first and second carriages, which carriages operably ride along respective first and second tracks of the support structure of the blind such that the slat, or a plurality of such slats, are slidably supported by the carriages along the lengths of the tracks.

The first and/or the second carriages of each of the slats may house a gearing cluster therein, and further wherein the geared carriages are interconnected thereby to transmit a rotational motion imparted on one of the slats to synchronised rotational motion of the other slats, such that in use, the slats are rotatable about their respective central slat axes, passing through their respective first and second mounting posts, between an open condition, wherein the major sides of adjacent slats are spaced relative to one another, and a shut condition, wherein the major sides of adjacent slats overlap one another.

Generally, the geared carriages are interconnected via a connector rod such that rotational motion of the slats about their respective central slat axes is translatable into a rotational motion of the connector rod about its central rod axis, which central rod axis is perpendicular to the central slat axes, such that operable rotation of any one slat or the connector rod causes synchronise rotation of all of the interconnected slats.

Typically, the plurality of slats are further interconnected, directly or indirectly, by one or more collapsible frames such that adjacent slats are slidably movable relative to one another across the tracks, the collapsible frames being configurable between an expanded condition and a compact condition.

In the expanded condition, the slats are spaced apart from one another along the track by the collapsible frame in an erected form In the compact condition, the slats are bunched together in close proximity to one another. Generally, the collapsible frames are configured to retain the spacing between the plurality of adjacent slats equidistant whether in the expanded condition, the compact condition or any condition therebetween.

Preferably, the slats are slidably movable into the compact condition near any one end of the track, or any other position therebetween. More preferably, the collapsible frame is a system of hinged and jointed trusses taking a pantograph-type form.

The carriages may ride along their respective tracks on bearings, wheels or bushings, the tracks being in the form elongate track members having a substantially C-shaped cross-section, the carriages being slidably captive within the elongate track members with the mounting posts connected between the carriages and the slats running along slots defined in such elongate track members.

Generally, one or more driving means and/or transmissions drive: (i) the relative movement of the slats between the retracted and extended condition; (ii) the rotation of the slats between the open and shut conditions; and (iii) the sliding of the slats along the tracks between the expanded and compact condition; the driving means being manual and/or mechanised.

Typically, the one or more transmissions is a system of pulleys and cords for at least driving the sliding of the slats along the tracks between the expanded and compact condition, the driving means and transmissions being substantially hidden from view within the support structure of the blind, such that manual or mechanised actuation of any one slat will drive the rotation and the sliding of the remaining slats.

Preferably, the one or more panels making up the slats are rigid thereby to in use act as a security barrier across a window opening or doorway across which the support structure of the blind is operably fitted.

More preferably, the slats are releasably lockable against rotation by one or more first locks acting on the slats, the carriages or the connector rod, and further wherein the slats are releasably lockable against sliding movement along the track by one or more second locks acting on the collapsible frames or the carriages.

Most preferably, one or more detectors are configured to monitor unauthorised movement of the slats, and/or unauthorised movement of an object between the slats, thereby to trigger an alarm and/or notification operably as a result of such unauthorised movement.

BRIEF DESCRIPTION OF THE INVENTION

The invention will now be described in more detail, by way of example only, with reference to the accompanying illustrations, in which.

DETAILED DESCRIPTION OF THE INVENTION

Figure 1:
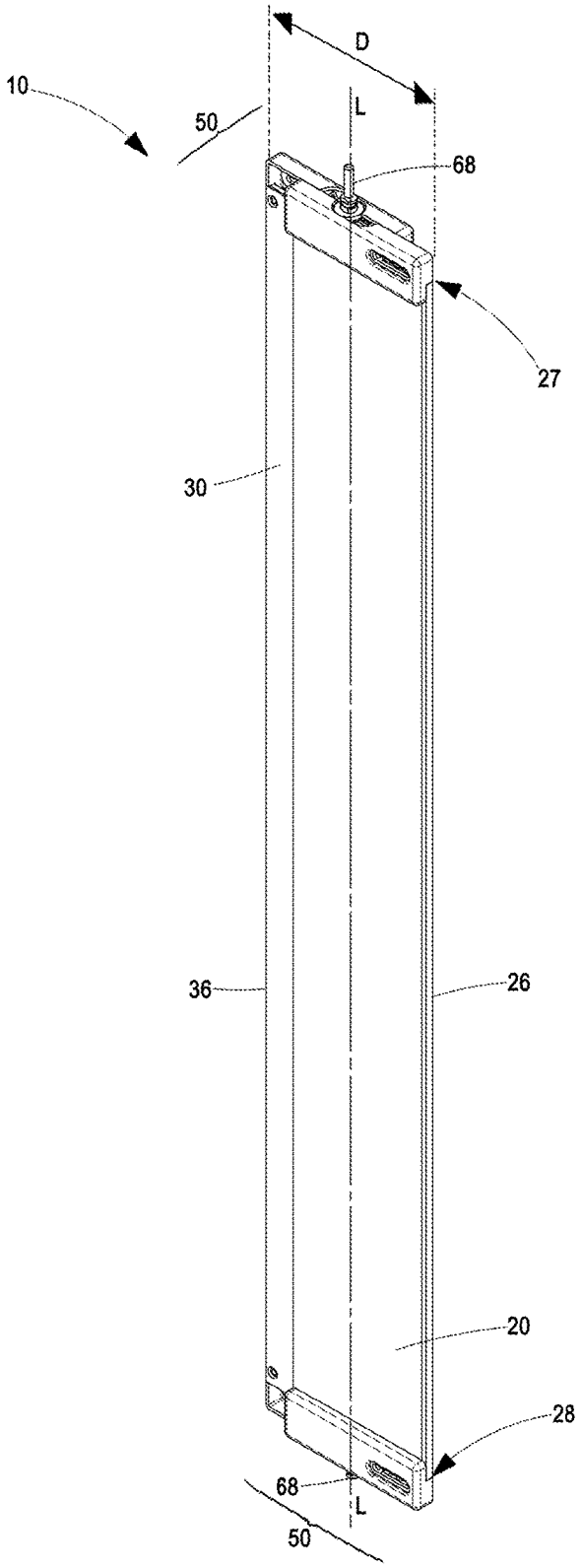
FIG. 1 is a perspective view of a slat for a blind in accordance with the present invention, showing the slat in an extended condition.
Figure 2:
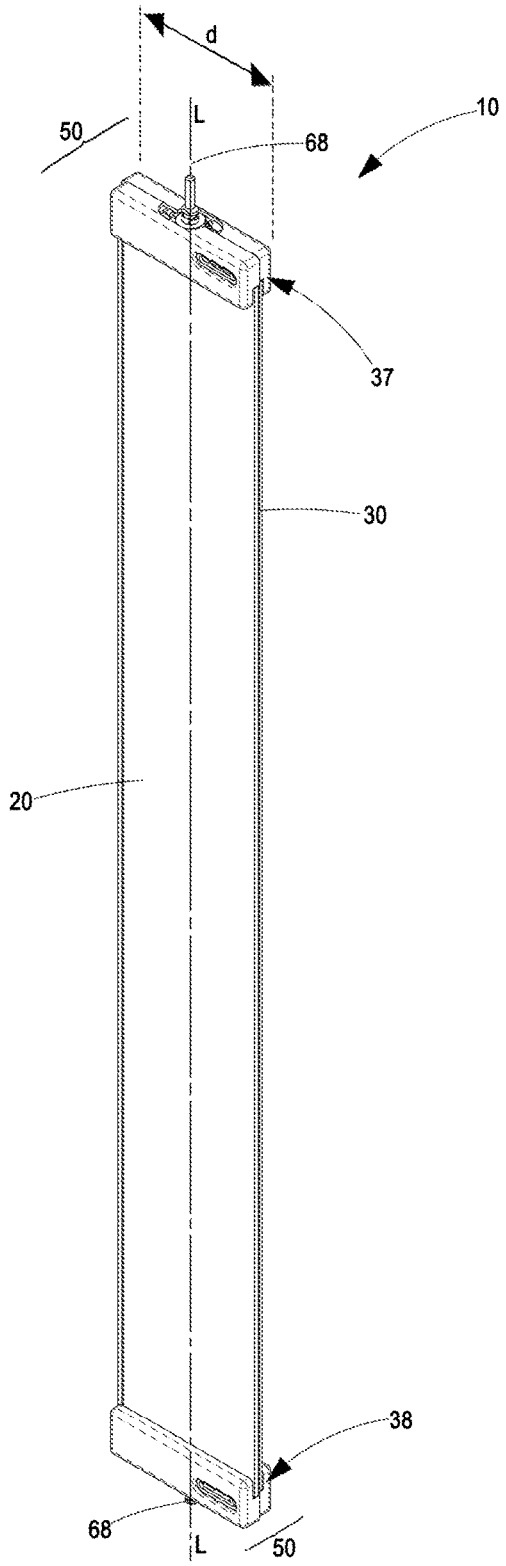
FIG. 2 is a perspective view of the slat of FIG. 1, showing the slat in a retracted condition.

A slat for a blind according to a preferred embodiment of the invention is designated generally in FIG. 1 and FIG. 2 by reference numeral 10. In a particularly preferred embodiment of the invention, the slat 10 comprises a pair of elongate composite slat panels 20, 30 and fasteners 50 located at each end of the respective slat panels 20, 30.

Figure 3:
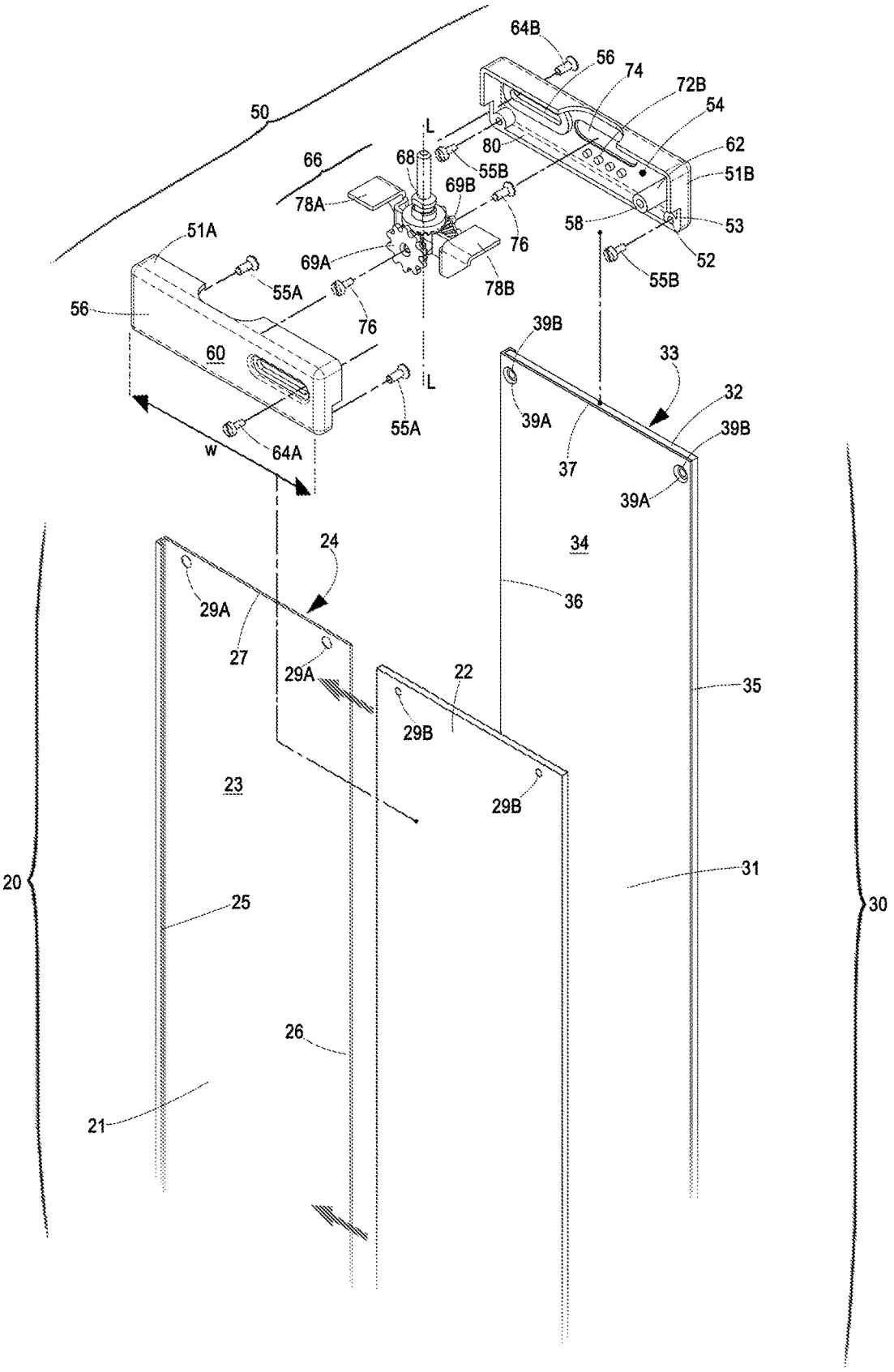
FIG. 3 is an exploded perspective view of an operatively upper end of the slat of FIG. 1.

With reference now also to FIG. 3, the composite slat panel 20 is made up of an elongate slat panel 21, which acts as a backing panel, and an elongate cover panel 22. The elongate slat panel 21 has opposing primary and secondary surfaces 23, 24; opposing primary and secondary major sides 25, 26 and opposing primary and secondary minor ends 27, 28.

Similarly, the composite slat panel 30 is made up of an elongate slat panel 31, which acts as a backing panel, and an elongate cover panel 32. The elongate slat panel 31 has opposing primary and secondary surfaces 33, 34; opposing primary and secondary major sides 35, 36 and opposing primary and secondary minor ends 37, 38.

It will be appreciated that with the cover panels 22, 32 substantially overlaid over the secondary surfaces 23, 33 of the respective elongate slat panels 21,31, the opposing major and minor sides of the elongate slat panels and the cover panels are substantially aligned and in use coincide. Accordingly, it will be appreciated that reference to the major and minor sides of the elongate slat panels 21, 31 will hereinafter be understood to also mean the major and minor sides of the cover panels 22, 32, as well as those of the composite slat panels 20, 30.

Although not required, it is preferable that at least one major side 25, 35 of the elongate slat panels 21, 31 comprises therealong an engagement lip, preferably U-shaped, for engaging the corresponding major side of the respective cover panel 22, 32.

The invention aims at providing a customer with a greater range of customisation as compared to what is possible with slats and blind systems currently available. It is envisaged that the cover panels 22, 32, to provide the intended degree of customisation, is preferably releasably securable to the elongate slat panels 21, 31 by the fasteners 50 such that the cover panels 22, 32 themselves are interchangeable.

The cover panels 22, 32 may be decorative panels made from a metallic material, wood or a material resembling a wood finish. Alternatively, the cover panels 22, 32 may be made from a high gloss material, such as stained or coloured glass or plastic.

The cover panels 22, 32 could for example also be made up from one or more photovoltaic panels. In this manner, it would be possible of the slats 10 to convert solar energy into electrical power.

The cover panels 22, 32 could also for example be made from a transparent or translucent material through which an intermediate decorative panel (not shown), sandwiched between the elongate slat panels 21, 31 and the cover panels 22, 32 is viewable. The intermediate decorative panel could be portions of, for example, a photograph. It will be appreciated that the decorative panels listed above are examples only and should not be interpreted as being an exhaustive list of possible alternatives.

The fasteners 50 are preferably in the form of clamps, made up of first and second clamping members 51A, 51B, that provide three functions, which will be expanded on in the description that follows.

The first of the three functions provided for by the first and second clamping members 51A, 51B is to releasably clamp together the composite slat panels 20, 30. Each of the first and second clamping members 51A, 51B comprises threaded panel mounting apertures 52 defined in panel mounting formations 53, which panel mounting formations 53 extend operatively inwardly from inner surfaces 54 of the respective clamping members 51A, 51B.

Panel mounting fasteners 55A, preferably in the form of bolts or grub screws, pass through aligned mounting apertures 29A in the elongate slat panel 21, mounting apertures 29B in the cover panel 22 and the panel mounting apertures 52 in the first clamping member 51A thereby to threadably clamp the cover panel 22 to the elongate slat panel 21 to form the composite slat panel 20. Furthermore, the first clamping member 51A is fastened in this manner to the composite slat panel 20. It will be appreciated that this principle is applied to both minor ends of the composite panel 20.

Similarly, panel mounting fasteners 55B, preferably in the form of bolts or grub screws, pass through aligned mounting apertures 39A in the elongate slat panel 31, mounting apertures 39B in the cover panel 32 and the panel mounting apertures 52 in the second clamping member 51B thereby to threadably clamp the cover panel 32 to the elongate slat panel 31 to form the composite slat panel 30. Furthermore, the second clamping member 51B is fastened in this manner to the composite slat panel 30. It will be appreciated that this principle is applied to both minor ends of the composite panel 30.

The second of the three functions provided for by the first and second clamping members 51A, 51B is to releasably clamp the composite slat panels 20, 30 in a back-to-back configuration such that in a loosened state the composite slat panels 20, 30 are slidable relative to one another, and in a tightened state the composite slat panels 20, 30 are locked relative to one another.

The first and second clamping members 51A, 51B each define therein a first fastening aperture 56 and a second fastening aperture 58, spaced from one another substantially across a width dimension "W" of the clamping members 51A, 51B, being substantially equal to the width of the composite slat panels 20, 30 as measured between their respective opposing major sides.

The first fastening aperture is in the form of a fastening slot 56 defined in an operatively outer face 60 of the clamping members 51A, 51B. The second fastening aperture is a threaded aperture 58 defined in a fastening post 62 extending operatively inwardly from inner surfaces 54 of the clamping members 51A, 51B.

A fastening bolt 64A passes through the fastening slot 56 in the first clamping member 51A to threadably engage the threaded aperture 58 in the second clamping member 51B. Similarly, a fastening bolt 64B passes through the fastening slot 56 in the second clamping member 51B to threadably engage the threaded aperture 58 in the first clamping member 51A.

Through the loosening and tightening of the fastening bolts 64A, 64B, the first and second clamping members 51A, 51B are capable of being loosened and tightened to one another. It will be appreciated that in a loosened state, the first and second clamping members 51A, 51B remain connected, but loosened to a point where the fastening bolts 64A, 64B are capable of riding along the respective fastening slot 56 within which they are captured, thereby to enable the first and second clamping members 51A, 51B, and consequentially the composite slat panels 20, 30 to slidably move relative to each other.

In the loosened state, the composite slat panels 20, 30 are capable of slidably moving relative to one another between a retracted condition (as illustrated in FIG. 2), an extended condition (as illustrated in FIG. 1) or any condition therebetween.

In the retracted condition, the respective primary and secondary major sides 25, 26; 36, 35 of each of the composite slat panels 20, 30 are substantially aligned with each other such that the slat 10 defines an operative retracted width dimension "d".

In the extended condition, the respective primary and secondary major sides 25, 26; 36, 35 of each of the composite slat panels 20, 30 are spaced relative to one another such that the slat 10 defines an operative extended width dimension "D", which operative extended width dimension "D" is greater than the operative retracted width dimension "d". It will be appreciate that the variable width of the slats 10 enables a blind made up of a plurality of such slats 10 to be fitted snugly within any window opening or doorway, making installation very easy.

With the slat 10 adjusted to the desired width dimension, the first and the second clamping members 51A, 51B may operatively be tightened such that the primary surfaces 24, 34 of each of the composite slat panels 20, 30 is operably forced into contact with each other (or an intermediate member therebetween) such that frictional forces acting between the respective contact surfaces 24, 34 frictionally lock the composite slat panels 20, 30 in position relative to one another.

The third of the three functions provided for by the first and second clamping members 51A, 51B is to actuate sliding movement of the clamping members 51A, 51B relative to one another. To enable this function, the first and second clamping members 51A, 51B house therebetween a mount 66, from which a mounting post 68 projects axially outwardly relative to a central longitudinal axis L-L of the slat 10.

The mount 66 supports a pair of pinion gears 69A, 69B meshed indirectly to one another by an intermediary gear 70, which intermediary gear 70 is mounted beneath the mounting post 68 and rotatable about the central longitudinal axis L-L. It will be appreciated that the intermediary gear 70 causes the pinion gears 69A, 69B to rotate in opposite directions.

The pinion gears 69A, 69B are configured to mesh with respective rack gear formations 72A, 72B lying adjacent locating slots 74, which locating slots 74 are located internally within and define by the clamping members 51A, 51B. It will be appreciated that a protuberance (not shown) of the pinion gears 69A, 69B, or a fastener 76 for fastening the pinion gears 69A, 69B to the mount 66 is slidably captive within the locating slots 74 thereby to enable meshing between the pinion gears 69A, 69B and the rack gear formations 72A, 72B.

It will be appreciated that the gear cluster acts to translate a rotational motion imparted on one of the pinions gears 69A, 69B (i.e. by manual actuation) into a linear sliding motion of the first and the second clamping members 51A, 51B relative to one another, thereby to actuate movement of the composite slat panels 20, 30 between the retracted and extended conditions.

The mount 66 is configured to "float" within the clamping members 51A, 51B thereby to remain centred on the slat 10. The mount 66 comprises a pair of support shoulders 78A, 78B flanking each side of the mounting post 68, and jointly on which the first and second clamping members 51A, 51B are slidably supported such that the mounting post 68 remains substantially mid-span between the opposing major outer sides 25, 35; 26, 36 of the slat 10. In this manner, regardless of the retracted/extended condition of the slat 10, the opposing mounting posts 68 will remain substantially co-axial with the central longitudinal axis L-L of the slat 10.

In an alternative embodiment (not shown), the mount 66 may be fitted with an off-centre mounting post 68, that is with the mounting post 68 parallel to but spaced from the longitudinal axis L-L, so as to allow for off-centre attachment of the slats 10 to the support structure 102 where the blind 100 is fitted to a shallow window opening.

In the preferred embodiment of the invention, the mounting posts 68 are restricted against rotation relative to the mount 66, and consequentially restricted against rotation relative to the composite slat panels 20, 30. In this manner, rotation imparted to the mounting posts 68 is transmittable to the composite slat panels 20, 30 thereby to rotate such composite slat panels 20, 30 at the same rate.

Figure 4:
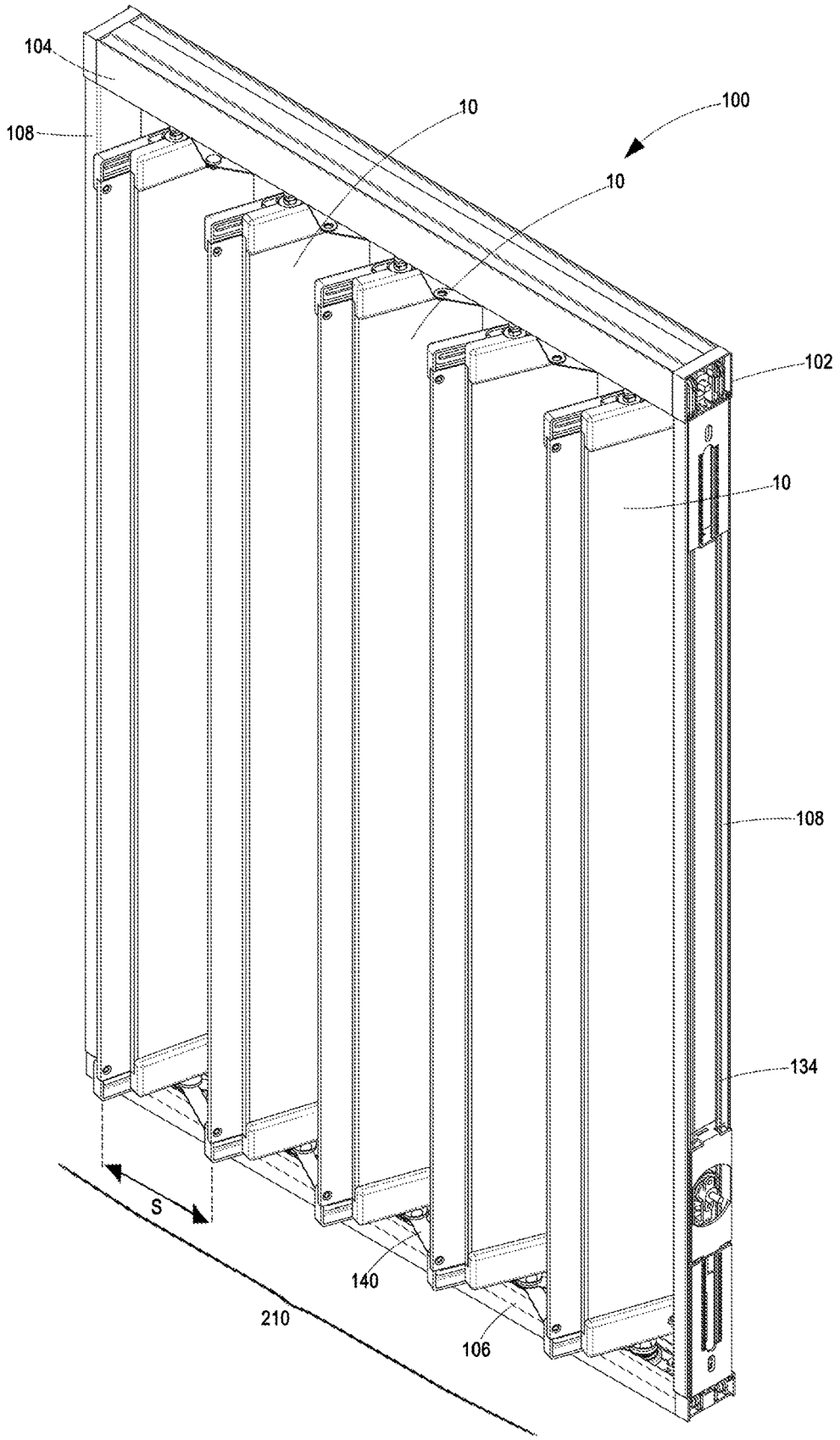
FIG. 4 is a perspective view of a blind with a plurality of slats supported in a support structure thereof in an extended and open condition.

FIG. 4 illustrates a blind 100 in which a plurality of slats 10 are rotatably mountable within a support structure 102. It will be appreciated that although the blind 100 has been illustrated such that the slats 10 are vertically orientated, the invention may equally be applied to a configuration where the slats 10 are orientated horizontally.

The support structure 102 comprises an upper track 104 and a lower track 106 spaced apart from one another by a pair of cross members 108. It will be appreciated that in use, at least one of the pair of cross members 108 may not be required where the upper and lower tracks 104, 106 are mounted to upper and lower surfaces of, for example, a window opening.

Figure 5:
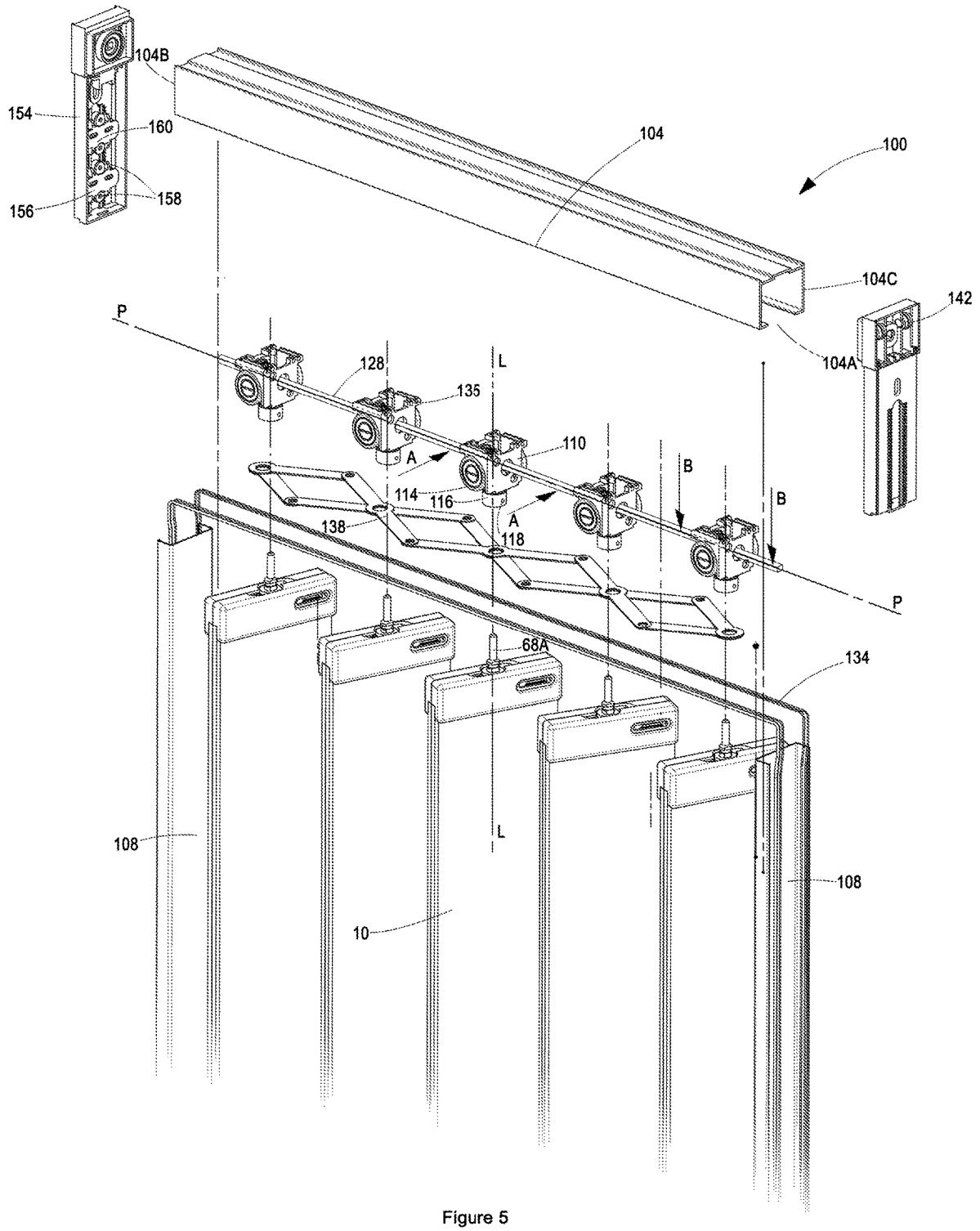
FIG. 5 is an exploded perspective view of an operatively upper end of the blind of FIG. 4.
Figure 6:
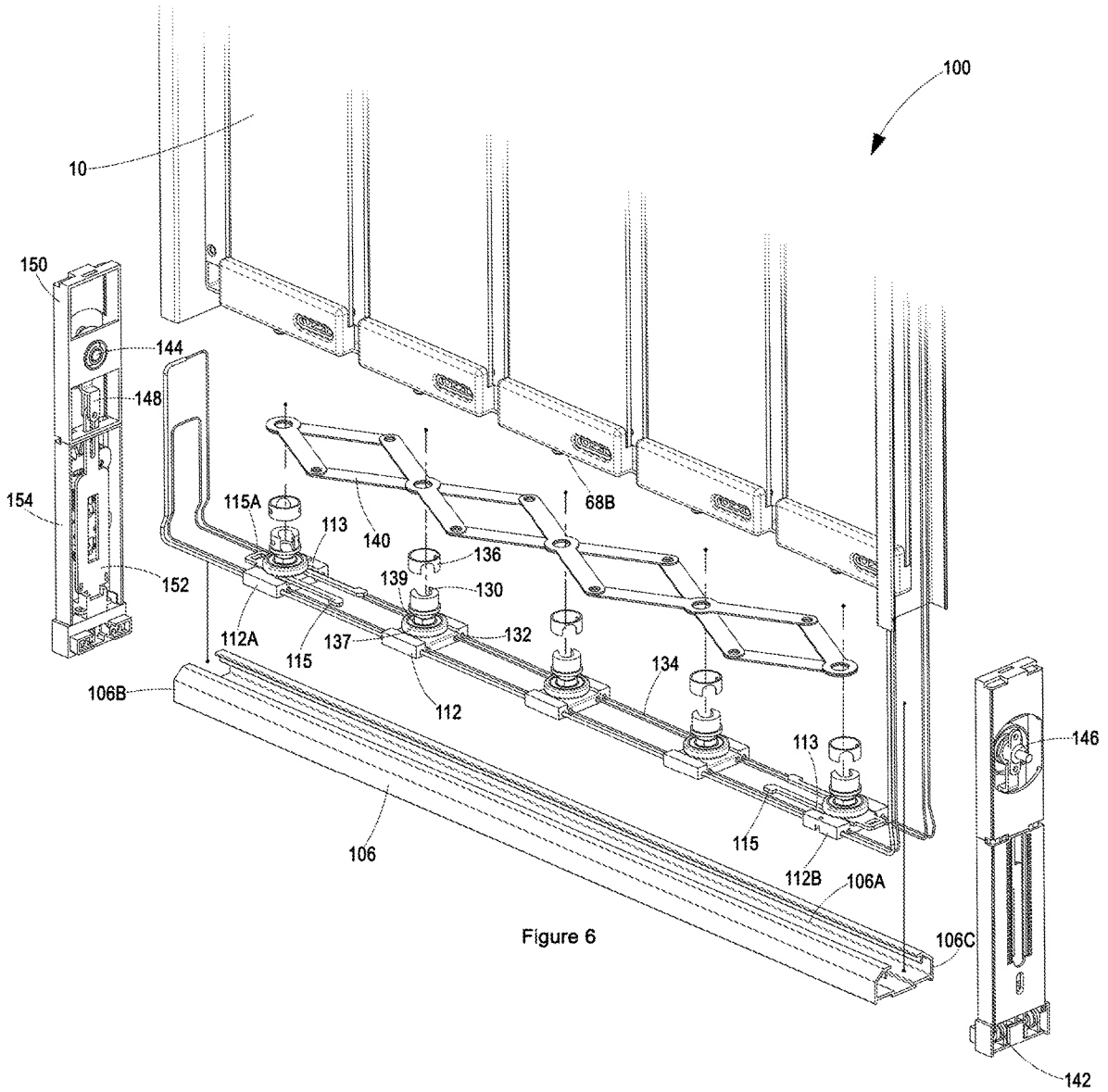
FIG. 6 is an exploded perspective view of an operatively lower end of the blind of FIG. 4.

With reference now also to FIG. 5 and FIG. 6, the slats 10 are each rotatably supported between the upper and lower tracks 104, 106 in the support structure 102 on respective first upper and second lower carriages 110, 112 each supporting respective free ends of the opposing mounting posts 68A, 68B.

The upper and lower tracks 104, 106 have a substantially C-shaped cross section, each defining a slot 104A, 106B configured so as to operatively face one another. Each of the first and second carriages 110, 112 are sized and shaped to remain captive within their respective tracks 104, 106, but capable of riding therealong between respective first and second ends 104B, 104C; 106B, 106C thereof.

It will be appreciated that the slots 104A, 106A are sized to enable the free ends of the opposing mounting posts 68 of the slats 10 to pass therethrough. In this manner, each of the slats 10 is supportable on a respective first and second carriage 110, 112 pair such that the slats 10 are movable along the tracks 104, 106.

Figure 9:
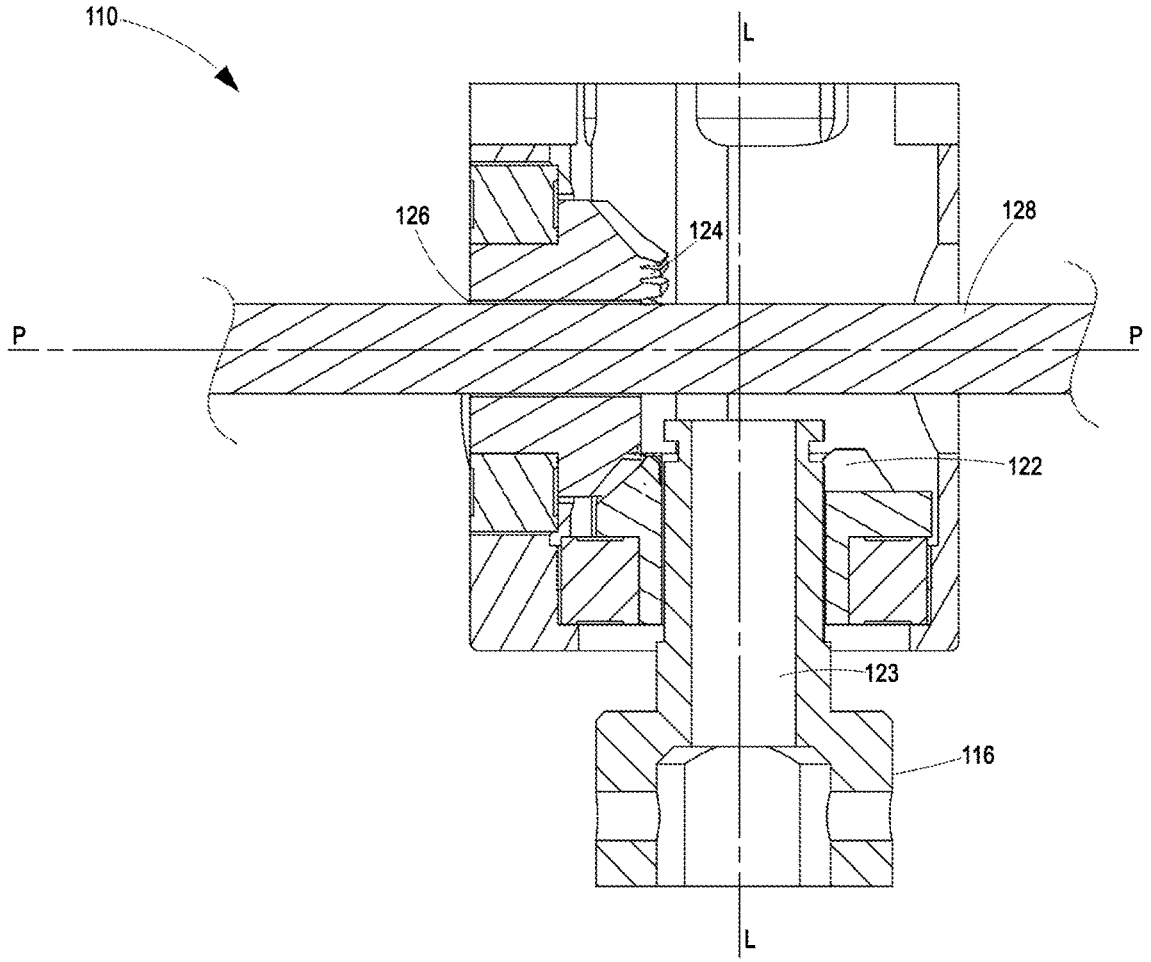
FIG. 9 is a cross-sectional front view of a first carriage of the blind, cross-section along axis P-P and viewed from A-A in FIG. 5.

The first carriages 110, with reference now also to FIG. 9, comprise wheels 114 on which they operatively ride along the upper track 104. The mounting post 68A of a respective slat 10 is engageable with a socket formation 116 sized and shaped for receiving the mounting post 68A therein such that the slat 10 is suspended from the first carriage 110.

Furthermore, the socket formation 116 defines a securing aperture 118 therein for engaging corresponding locating fasteners 120, preferably grub screws, for securing the mounting post 68A there into, thereby to transmit rotation of the socket formation 116 about the central longitudinal axis L-L to the mounting post 68A and consequentially to the slat 10.

Figure 10:
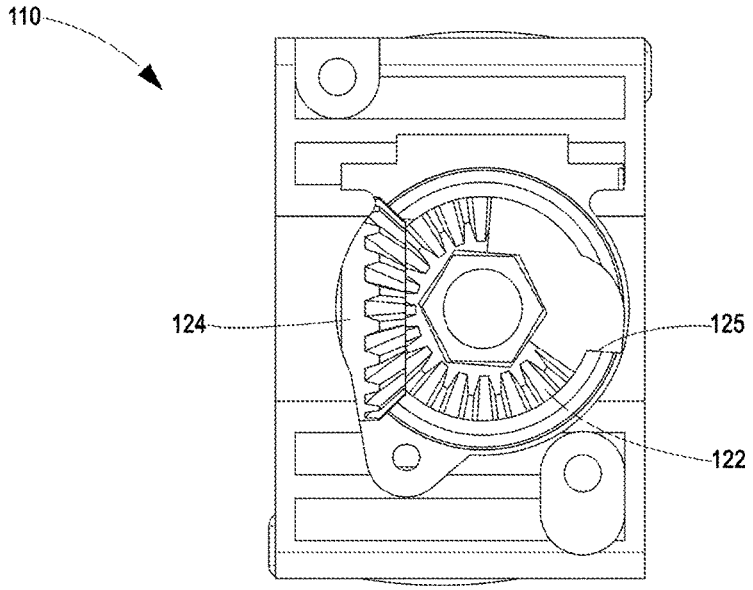
FIG. 10 is a cross-sectional top view of a first carriage of the blind, cross-section along axis P-P and viewed from B-B in FIG. 5.

The first carriages 110 also each house a gearing cluster therein made up from a primary gear 122 and a secondary gear 124. The primary gear 122 is configured to rotate with the socket formation 116 and as such, is rotatable about the central longitudinal axis L-L within a set range, limited by limiter formation 125 on the primary gear 122, as illustrated in FIG. 10. In the preferred embodiment as illustrated in the accompanying figures, the primary gear 122 defines a central bore 123 for at least partially receiving the mounting post 68 therein.

Similarly, the secondary gear 124 defines central bore 126 for receiving a connector rod 128, which connector rod 128 extends through the secondary gear 124 of a plurality of aligned first carriages 110 retained captive in the upper track 104 such that the connector rod 128 and the secondary gear 124 are rotatable about a central longitudinal axis P-P, which axis P-P is perpendicular to the central longitudinal axis L-L.

With the primary gear 122 meshed with the secondary gear 124, rotation imparted on any one slat 10 is transmittable into the first carriage 110 via the connected mounting post 68 and socket formation 116. Such rotation is then transmittable to the connector rod 128 via the meshed primary and secondary gears 122, 124.

The connector rod 128 then transmits the rotation through the meshed primary and secondary gears 122, 124 and the socket formation 116 of the other first carriages, thereby to rotate the other of the mounting posts 68 and consequentially the slats 10 such that all of the slats 10 making up the blind 100 rotate synchronously.

Figure 7:
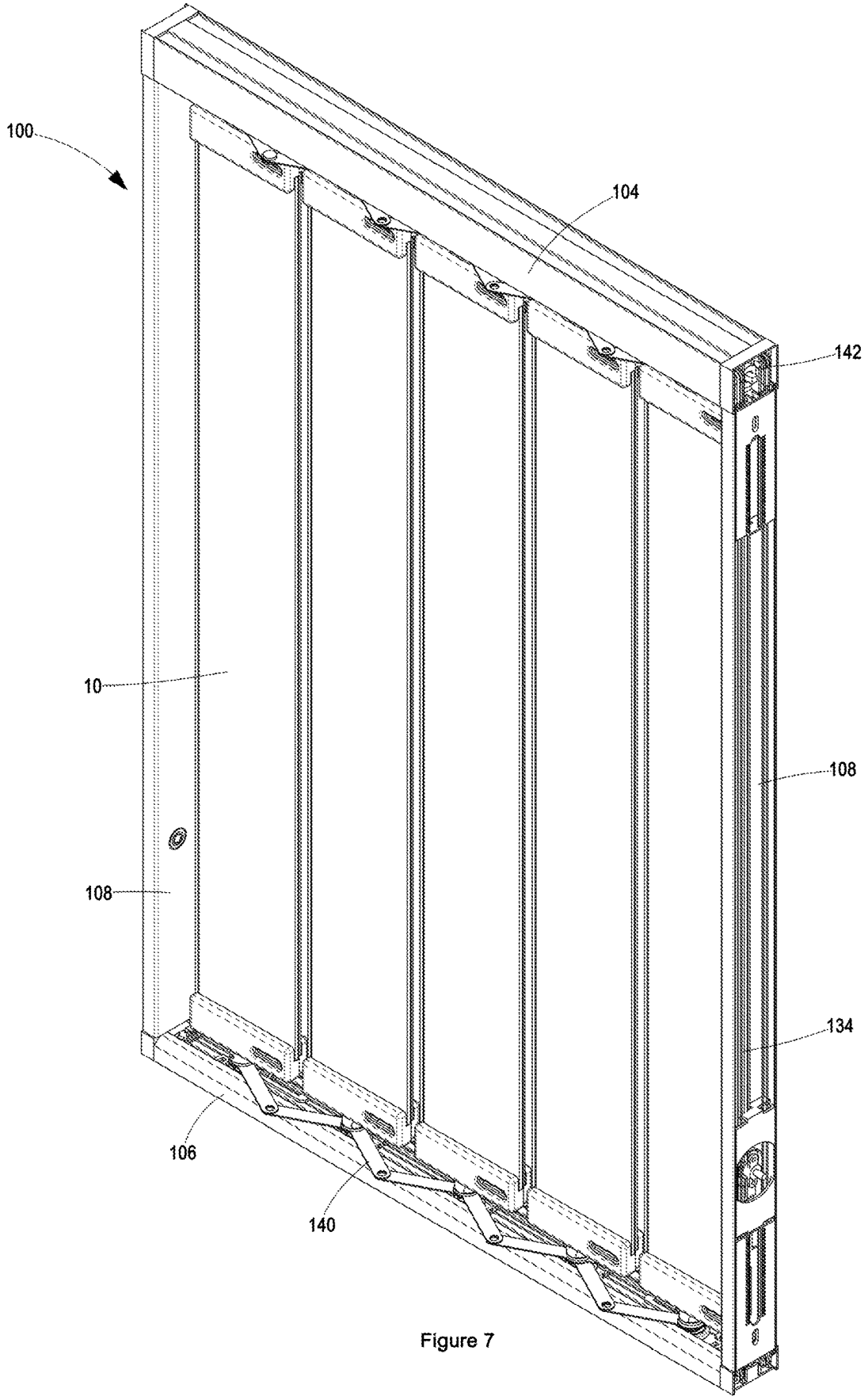
FIG. 7 is a perspective view of the blind of FIG. 4 with the slats in an extended and shut condition.

In this manner, the slats 10 are rotatable about their respective central slat axes L-L between an open condition as illustrated in FIG. 4, wherein the major sides of adjacent slats 10 are spaced relative to one another to allow light and visibility therethrough, and a shut condition as illustrated in FIG. 7, wherein the major sides of adjacent slats 10 overlap one another thereby to restrict light and visibility therethrough.

It will be appreciated that instead of initiating rotation of the slats 10 by imparting such rotation to one of the slats 10, the rotation could instead be imparted on the connector rod 128 thereby to initiate synchronous rotation of the slats 10.

On the operative lower ends of the slats 10, and with reference now to FIG. 6, the second carriages 112 are carrier blocks defining on one surface thereof a lower socket formation 130 for accommodating the lower mounting post 68B therein, and near a second opposing surface a plurality of apertures 132, for accommodating a plurality of transmission cords 134.

With the lower mounting post 68B received in the lower socket formation 130, a locking ring 136 is pressed downwardly over the lower socket formation 130 and then secured thereto with grub screws so as to retain engagement between the lower socket formation 130 and the mounting post 68B. In this manner, rotation of the slats 10 is further transmittable about the central longitudinal axis L-L to the bottom mounting post 68B and consequentially to the slat 10.

A wheel 137 is located on the mounting socket 130 of each the second carriages 112, located over a bearing 139, to operatively lie within the lower track 106 for engaging one of the opposing lateral major sides of the lower track 106 to keep the second carriages 112 running centred therealong.

With reference specifically to FIGS. 4 to 6, a first upper collapsible frame 138 is located operatively above the plurality of slats 10 making up the blind 100 and configured to engage the upper mounting posts 68 thereof.

Figure 8:
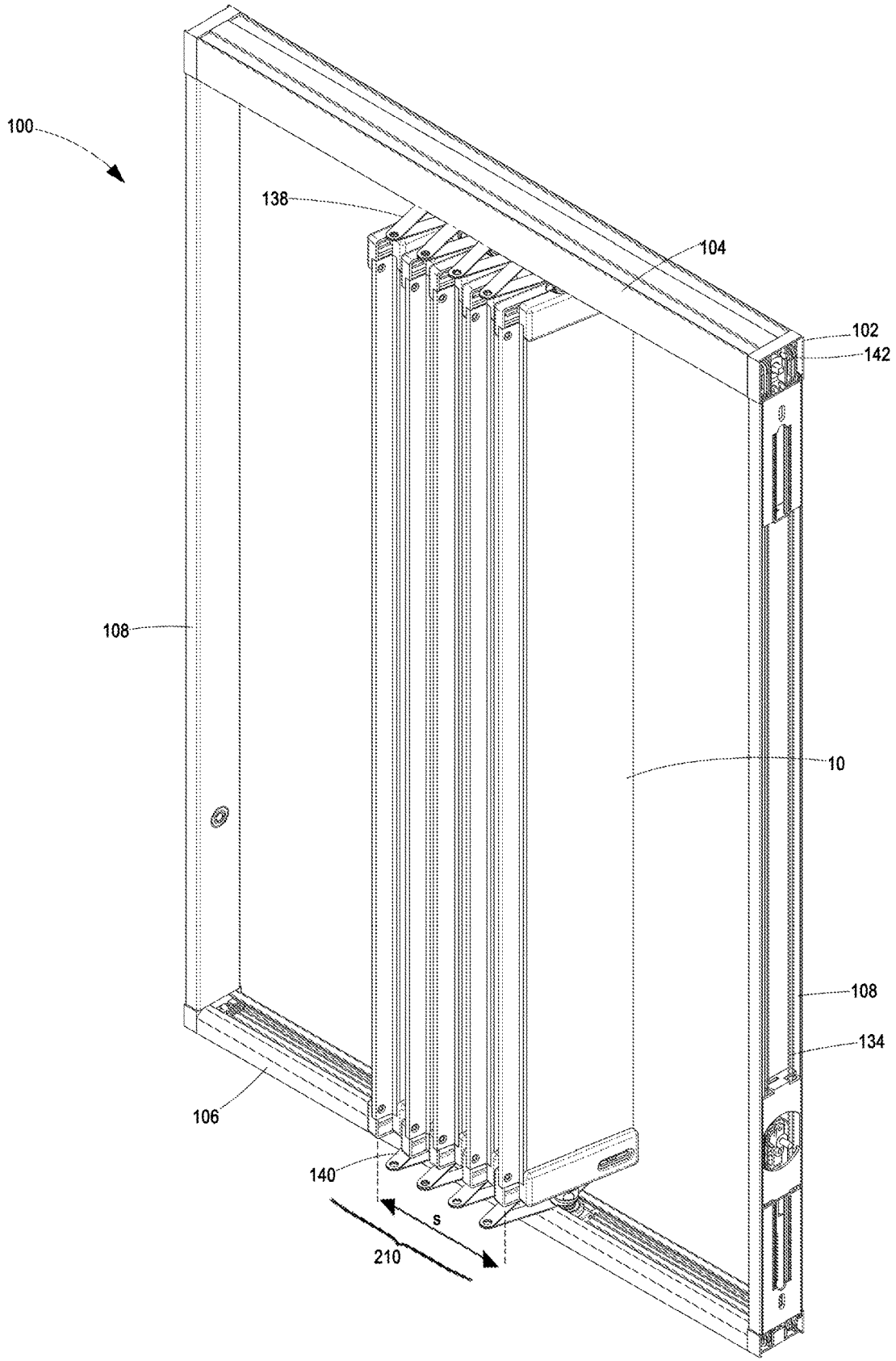
FIG. 8 is a perspective view of the blind of FIG. 4 with the slats in a compact and open condition.

Similarly, a second lower collapsible frame 140 is located operatively below the plurality of slats 10 and configured to engage the mounting socket 130 of each of the second carriages 112, or the mounting post 68B passing between the slats 10 and the second carriages 112. The first and second collapsible frames 138, 140 co-operatively enable relative sliding movement of the slats 10 relative to one another and in unison across the tracks 104, 106 between an expanded condition (as illustrated in FIG. 4) and a compact condition (as illustrated in FIG. 8).

At least the outer most second carriages 112A, 112B each comprise a stepped recess 113 on an upper side thereof for accommodating a sliding lock 115 therein. In an unlocked condition between the second carriages 112A, 112B and the sliding lock 115, with a forked end of the sliding lock extending away from the carriages 112A, 112B (as depicted in FIG. 6), the second carriages 112 are free to slide along the track 106.

In a locked condition (not shown), the forked end of the sliding locks 115 are received in the stepped recess 113, thereby to lock the second carriages relative to the track 106. It will be appreciated that in such locked position, the slats 10 remain free to rotate relative to the second carriages 112. It will be appreciated further that the locking may be employed through use of a slam lock mechanism composed of a cam lock 144, a cam 146 and pin arm 148, mounted within a lock holder 150.

The cam 146 is rotatably linked to pin arm 148, which is rotatably linked to a side lock plate 152. An operatively lower tapered bottom edge of side lock plate 152, which is spring-mounted within an operatively upper end of a side upright 154, is engageable within a sliding lock aperture 115A of the sliding lock 115 when the second carriages 112A and/or 1128 are operatively slid to the respective ends of the track 106B or 106C respectively.

In the expanded condition, the slats 10 are generally spaced apart from one another along the tracks 104, 106 by the collapsible frames 138, 140 in an erected form. In the compact condition, the slats 10 are typically bunched together in close proximity to one another.

With the collapsible frames 138, 140 being formed from a system of hinged and jointed trusses in a pantograph-type structure, the slats 10 are movable between the expanded and compact condition in a manner to retain the spacing between the plurality of adjacent slats 10 equidistant whether in the expanded condition (see spacing "S" in FIG. 4), the compact condition (see spacing "s" in FIG. 8) or any condition therebetween.

Furthermore, and although the slats 10 are illustrated in FIG. 8 as lying in the centre of the blind support structure 102 when in the compact condition, it will be appreciated that the slats 10 are free floating and capable of being bunched or stacked in the compact condition at any location along the tracks 104, 106 (i.e. at either end of the tracks or any location therebetween).

In this manner, a modular blind structure is configurable, within a single blind support structure 102, to have a plurality of slat sets 210 made up of any number of slats 10 (i.e. in the illustrated figures, three slats 10 make up a slat set 210) which can each be actuated to move between their respective extended, retracted, expanded, compact, open and/or shut conditions individually, either manually or by some mechanisation.

Where the blind 100 is a manually actuated system, any one slat 10 may act as a master slat, to which sliding movement along the tracks 104, 106, as well as rotational movement may be applied by hand thereby to drive sliding movement and rotation of the remaining blinds.

The blind 100 may also include a transmission for transmitting a sliding and rotating movement to the slats 10. For example, the transmission may be made up of the plurality of transmission cords 134 passing over a plurality of transmission pulleys 142, which transmission cords 134 are substantially hidden from view within the blind support structure 102 and connected to one or more of the first and/or second carriages 110, 112 thereby to transmit a movement imparted to such transmission cords 134 to the slats 10, or vice versa.

With reference again to FIG. 5, the transmission cords 134 are arranged to lie within corresponding semi-enclosed channels 135 defined in operative upper sides of the first carriages 110, and retained therein with the upper sides of the first carriages 110 and the cord 134 operatively riding in close proximity with an upper inner surface of the upper track 104.

The outer transmission cord 134 is threaded through an outer rope tensioning system, located toward the top and bottom sections of the cross member, which rope tensioning system is made up of a tensioner cover 156, behind which sits a bearing holder, holding bearings therein acting as pulleys for the cords 134. The outer rope tensioning system further comprises a tensioner base 158, which engages with a slotted track near an operatively upper end of the side upright 154 thereby to tension the cord 134.

The inner transmission cord 134 is threaded through an inner rope tensioning system, located operatively higher in the side upright 154 than the outer rope tensioning system, which inner rope tensioning system comprises a tensioner cover 160 similarly comprising a bearing holder and a tensioner base behind such tensioner cover 160. The bearing holder of the inner rope tensioning system hold bearing that act as pulleys, with the tensioner cover 160 being engageable with the slotted track in side upright 154 thereby to tension the cord 134.

The blind 100 may further include one or more driving means (not shown), such as motors, for mechanising the operation and movement of the slats 10.

Although the composite slat panels 20, 30 may be made from any number of different materials, it is preferable that at least the elongate slat panels 21, 31 thereof, which act as backing panels, are made from a rigid material such that the slats 10 double in use as a security barrier, in the aim of reducing the requirement of burglar proofing in the home. It is envisaged that the elongate slat panels 21, 31 may be made from aluminium or another metallic material.

To double as a security barrier, the slats 10 are releasably lockable against rotation by one or more first locks (not shown) acting to lock the slats 10, the carriages 110, 112 or the connector rod 128 against rotation.

Furthermore, the slats 10 are releasably lockable against sliding movement along the tracks 104, 106 by one or more second locks acting to lock the carriages 110, 112 relative to the tracks 104, 106 against expanding or compacting.

In one particularly preferred embodiment of the invention, one or more detectors are configured to monitor unauthorised movement of the slats 10, and/or unauthorised movement of an object between the slats 10, thereby to trigger an alarm and/or notification of such unauthorised movement.

Although the invention has been described with reference to a preferred embodiment, it will be appreciated that many modifications or variations of the invention are possible without departing from the spirit or scope of the invention. For example, instead of clamping the composite slat panels 20, 30 to one another to form the slats 10, the composite slat panels 20, 30 may simply be connected by bolts and nuts directly.

In another example the composite slat panels 20, 30 and their corresponding backing panels 21, 31 may consist of single panels (i.e. combining the slat panel with its backing panel).

The slats 10, or blind 100, may be illuminated and capable of changing the illumination colour. Furthermore, it will be appreciated that the intermediate decorative panel may double as, or instead be replaced by, an insulation panel.

The invention claimed is:

1. A blind including:

a slat having:

(i) a pair of elongate slat panels having: (i) opposing primary and secondary surfaces; (ii) opposing primary and secondary major sides; and (iii) opposing primary and secondary minor ends; the slat panels being slidably movable relative to one another between a retracted condition, wherein the respective primary and secondary major sides of each of the slat panels lie in close proximity in alignment with one another, and an extended condition, wherein the respective primary and secondary major sides of each of the slat panels are spaced relative to one another such that a dimension of the slat, as measured between the primary major side of one of the slat panels and the secondary major side of the other of the slat panels, is variable; and (ii) one or more fasteners, located at or near each of the opposing primary and secondary minor ends of the slat panels, for releasably fixing the pair of slat panels to one another;

characterized in that the one or more fasteners are configurable between a loosened state, wherein the slat panels are slidably movable between the retracted and extended conditions, and a tightened state, wherein the primary surfaces of each of the slat panels is operably forced into contact with each other, or an intermediate member therebetween, such that frictional forces acting between respective contact surfaces frictionally lock the slat panels in position relative to one another, whether in the retracted condition, the extended condition or any condition there between, thereby to operatively restrict relative movement between the slat panels in such fixed condition.

2. The blind according to claim 1, wherein each of the slat panels is substantially overlaid on the secondary surface thereof with an elongate cover panel thereby to form first and second composite slat panels such that the opposing primary and secondary minor ends of each slat panel are substantially aligned with, or longitudinally extend beyond, respective opposing primary and secondary minor ends of the respective cover panel, characterised in that the fasteners:

releasably clamp the cover panel to the respective slat panel;

are receivable on respective ones of the opposing primary and secondary minor ends of the respective composite slat panel, or on respective ones of exposed end portions of respective ones of the opposing primary and secondary minor ends of the respective slat panel extending longitudinally beyond the cover panel overlaid thereon; and are in the form of:

(i) bolts and nuts with a shank portion of the respective bolt passable through aligned fastening apertures, defined in the exposed end portions of the slat panel and spaced apart from one another across a dimension spanning between the opposing primary and secondary major sides of the respective slat panel, such that the composite slat panels are operably clamped together between a head of the bolt and the nut threadably tightened onto the shank portion thereof, wherein at least one of the fastening apertures is a slot; or (ii) for also releasably clamping the pair of composite slat panels to one another between the respective loosened and tightened states.

3. The blind according to claim 2, wherein the clamps at each of the opposing primary and secondary minor ends of the composite slat panels are each made up of a first clamping member and a second clamping member between which the respective minor ends of such composite slat panels are capable of being releasably clamped, and further wherein:

each of the first and the second clamping members define therein at least first and second fastening apertures spaced apart from one another across a dimension spanning between the opposing primary and secondary major sides of the composite slat panels to which the clamping members are fastenable, such that bolts are receivable through aligned fastening apertures in each of the first and second clamping members thereby to releasably clamp the composite slat panels to one another;

at least a first bolt being passable through the first fastening aperture in the first clamping member to threadably engage the second fastening aperture in the second clamping member, with at least a second bolt being passable through the first fastening aperture in the second clamping member to threadably engage the second fastening aperture in the first clamping member such that the clamping members, and consequentially the composite slat panels sandwiched therebetween, are operably clamped together by threadably tightening the first and second bolts into the respective second fastening apertures; and the first fastening aperture in each of the clamping members is a fastening slot and, with the respective bolt passing through such fastening slot loosened from the corresponding second fastening aperture, the shank portion of the respective bolt being capable of riding along the fastening slot thereby to enable slidable movement between the clamping members and consequentially the composite slat panels, the composite slat panels being operably clamped to one another by retightening at least one of the first and second bolts into the respective second fasting aperture to force the primary surfaces of the composite slat panels into contact with each other, or the intermediate member therebetween, to frictionally lock the composite slat panels in position relative to one another.

4. The blind according to claim 3 including a support structure, and the slat including a first mounting post extending axially outwardly from the primary minor end of at least one of the composite slat panels, and a second mounting post extending axially outwardly from the secondary minor end of at least one of the composite slat panels, the slat being rotatably mountable to the support structure via the first and second mounting posts, wherein:

each mounting post extends from a respective mount fastened to one or both of the composite slat panels by respective ones of the fasteners so that the mounting post is restricted against rotation relative to the mount, and consequentially restricted against rotation relative to the composite slat panels to which the mount is fastened.

5. The blind according to claim 4 including a gear cluster co-operative between: (i) each of the first and the second clamping members; and (ii) the respective mount; for translating a rotational motion imparted on the gear cluster into a linear sliding motion of the first and the second clamping members, and consequently the composite slat panels, relative to one another, wherein the gear cluster is made up from: (i) a pair of pinion gears supported on the respective mount and meshed indirectly to one another via an intermediary gear; and (ii) a rack gear formation on each of the first and the second clamping members, and further wherein the rack gear formations are located adjacent locating slots, defined in each of the first and the second clamping members and along which a portion of: (i) a protuberance of the pinion gears; or (ii) a fastener for fastening the pinion gears to the respective mount; is slidably captive.

6. The blind according to claim 5, wherein the at least one of the primary and secondary major sides of the slat panels comprises an engagement lip therealong for engaging the corresponding major side of the respective cover panel, and further wherein:

the cover panel is permanently attachable or releasably attachable to the respective slat panel, the cover panel further comprising at least one of:

(i) one or more photovoltaic panels for generating electricity;

(ii) a decorative panel; and (iii) a transparent or translucent panel through which & an intermediate decorative panel is viewable, the intermediate decorative panel being securable in position sandwiched between the slat panel and the cover panel; and wherein at least one of the decorative panel and the intermediate decorative panel is interchangeable or customizable.

7. The blind according to claim 6, wherein respective first ends of the first and second mounting posts, opposite to respective second ends thereof mounted to the slat, are engageable with respective first and second carriages, which carriages operably ride along respective first and second tracks of the support structure of the blind such that the slat is slidably supported by the carriages along respective lengths of the respective first and second tracks.

8. The blind according to claim 7, including a plurality of slats, wherein the first carriages, the second carriages or both the first and the second carriages house a gearing cluster therein, and further wherein the first and second carriages are interconnected by the respective one or more gearing clusters to transmit a rotational motion imparted on one of the slats to synchronised rotational motion of another of the slats, such that in use, the slats are rotatable about their respective central slat axes, passing through their respective first and second mounting posts, between an open condition, wherein the major sides of adjacent ones of the slats are spaced relative to one another, and a shut condition, wherein the major sides of adjacent ones of the slats overlap one another.

9. The blind according to claim 8, wherein the first and second geared carriages are interconnected via a connector rod such that rotational motion of the slats about their respective central slat axes is translatable into a rotational motion of the connector rod about its central rod axis, which central rod axis is perpendicular to the central slat axes, such that operable rotation of any one slat or the connector rod causes synchronized rotation of all of the interconnected slats.

10. The blind according to claim 9, wherein the plurality of slats are further interconnected, directly or indirectly, by one or more collapsible frames such that adjacent ones of the slats are slidably movable relative to one another across the tracks, the one or more collapsible frames being configurable between an expanded condition, wherein the interconnected slats are spaced apart from one another along the respective track by the collapsible frame in an erected form, and a compact condition, wherein the interconnected slats are bunched together in close proximity to one another, the one or more collapsible frames being configured to retain an equidistant spacing between the plurality of adjacent slats.

11. The blind according to claim 10, wherein the slats are slidably movable into the compact condition near any one end of the respective track, or any other position therebetween.

12. The blind according to claim 11, wherein the one or more collapsible frames are each a system of hinged and jointed trusses taking a pantograph-type form.

13. The blind according to claim 12, wherein the first and second carriages ride along their respective tracks on bearings, wheels or bushings, the respective tracks being in the form of elongate track members having a substantially C-shaped cross-section, the first and second carriages being slidably captive within the elongate track members with the respective mounting posts connected between the carriages and the slats running along slots defined in such elongate track members, characterized in that one or more of: (i) one or more driving means, and (ii) one or more transmissions drive: (i) the relative movement of the slats between the compact and expanded conditions; (ii) the rotation of the slats between the open and shut conditions; and (iii) the sliding of the slats along the respective tracks between the expanded and compact conditions; the driving means being at least one of manual and mechanised.

14. The blind according to claim 13, wherein each of the one or more transmissions comprise a system of pulleys and cords for at least driving the sliding of the slats along the respective tracks between the expanded and compact conditions, the driving means and transmissions being substantially hidden from view within the support structure of the blind, such that manual or mechanised actuation of any one slat will drive the rotation and the sliding of the remaining slats.

15. The blind according to claim 14, wherein the slat panels making up the slats are rigid thereby to in use act as a security barrier across a window opening or doorway, and further wherein:

the slats are releasably lockable against rotation by one or more first locks acting on the slats, the first and second carriages or the connector rod, the slats being releasably lockable against sliding movement along the respective track by one or more second locks acting on the one or more collapsible frames or the first and second carriages; and one or more detectors are configured to monitor unauthorised movement of the slats, or unauthorised movement of an object between the slats, thereby to trigger an alarm or notification operably as a result of such unauthorised movement.

* * * * *